US006662808B2

(12) United States Patent
Leason et al.

(10) Patent No.: US 6,662,808 B2
(45) Date of Patent: Dec. 16, 2003

(54) HAIR WRAPPER

(75) Inventors: David Leason, Chappaqua, NY (US); Edward J. Ellis, New York, NY (US); Eugene J. Lattuga, Bonita Springs, FL (US)

(73) Assignee: Elysee Beauty Products, Ltd., Kwai Chung (HK)

( * ) Notice: Subject to any disclaimer, the term of this patent is extended or adjusted under 35 U.S.C. 154(b) by 0 days.

(21) Appl. No.: 10/216,371

(22) Filed: Aug. 9, 2002

(65) Prior Publication Data

US 2003/0168074 A1 Sep. 11, 2003

(51) Int. Cl.[7] ..... A45D 7/02; B65H 49/38

(52) U.S. Cl. ..... 132/212; 132/271; 57/13; 242/597.3; 242/594; 242/442

(58) Field of Search ..... 57/13, 15, 3, 4, 57/5, 58.83; 87/33, 62; 242/442, 422.4, 594, 439.6, 597.3, 593; 132/212, 271, 273, 56

(56) References Cited

U.S. PATENT DOCUMENTS

| | | | |
|---|---|---|---|
| 1,048,687 | A | 12/1912 | Goodrick |
| 1,392,611 | A | 10/1921 | Adams |
| 1,927,261 | A | 9/1933 | Evans |
| 2,792,775 | A | 5/1957 | Beyette |
| 3,259,370 | A | 7/1966 | Neale, Sr. |
| 4,038,996 | A | 8/1977 | Eronini et al. |
| 4,346,550 | A | 8/1982 | Ferree |
| 4,580,585 | A | 4/1986 | Sapkus |
| 4,583,561 | A | 4/1986 | Larsson |
| 4,824,036 | A | 4/1989 | Buta |
| 4,856,721 | A | 8/1989 | Bonello et al. |
| 5,404,892 | A | 4/1995 | Bretl |
| 5,456,271 | A | 10/1995 | Legette |
| 5,488,963 | A | 2/1996 | Fishman |
| 5,558,105 | A | 9/1996 | Rosenwinkel et al. |
| 5,671,759 | A | 9/1997 | Chung et al. |
| 5,810,022 | A | 9/1998 | Reynolds |
| 5,967,151 | A | 10/1999 | Villani et al. |
| 5,988,181 | A | 11/1999 | Gable et al. |
| 6,109,275 | A | 8/2000 | Mendezmonsanto |
| 6,318,378 | B1 | 8/2000 | Mendezmonsanto |

FOREIGN PATENT DOCUMENTS

| | | |
|---|---|---|
| JP | 58-177683 | 10/1983 |
| JP | 02-104305 | 4/1990 |
| JP | 07-216678 | 8/1995 |
| JP | 08-052016 | 2/1996 |
| JP | 08-052017 | 2/1996 |
| JP | 3024761 | 3/1996 |
| JP | 3036455 | 1/1997 |
| JP | 10-033241 | 2/1998 |
| JP | 2001-218615 | 8/2001 |

OTHER PUBLICATIONS

U.S. patent application Ser. No. 10/214,926, Leason filed Aug. 7, 2002.

*Primary Examiner*—Kevin Shaver
*Assistant Examiner*—Stephanie Willatt
(74) *Attorney, Agent, or Firm*—Darby & Darby

(57) ABSTRACT

An apparatus for wrapping hair with a cord is provided and includes a housing; a main spindle operatively coupled to the housing and defining a main spindle bore for receiving cord and hair; a rotatable spool carrier and at least one spool. The spool carrier has a platform and a drive spindle operatively coupled to the main spindle so that rotation of the main spindle is translated into rotation of the platform. The drive spindle has guides for receiving cord and permitting the cord to be disposed through a bore extending through the drive spindle. The rotation of the main spindle causes cord to be dispensed through the one guide and the drive spindle bore and the main spindle bore, hair is disposed through the drive spindle bore and the main spindle bore, and the main spindle is rotated to wrap the hair with cord.

32 Claims, 4 Drawing Sheets

FIG. 3
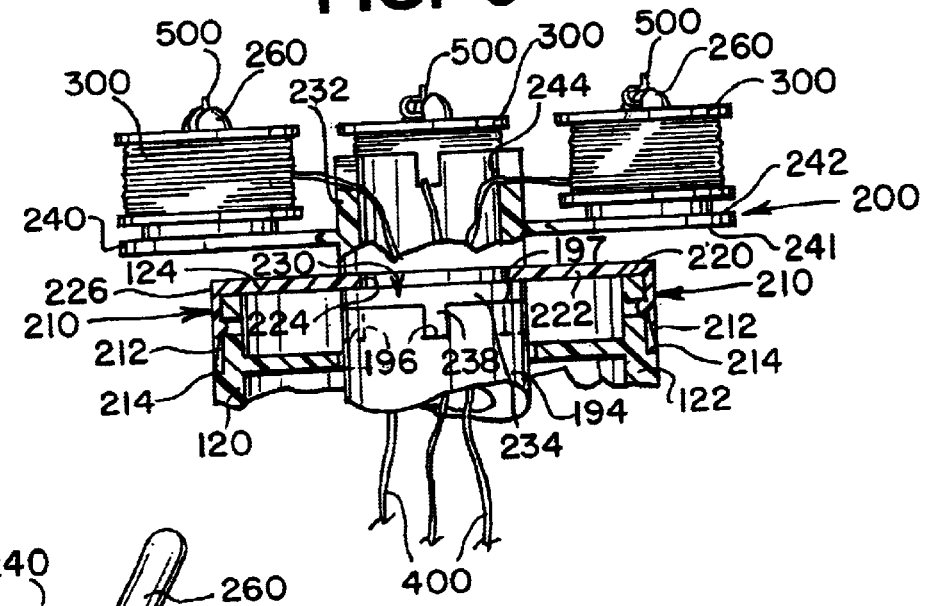
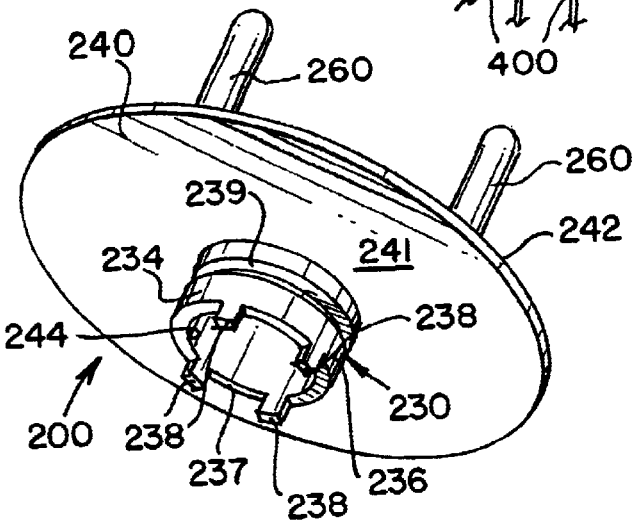
FIG. 4
FIG. 5
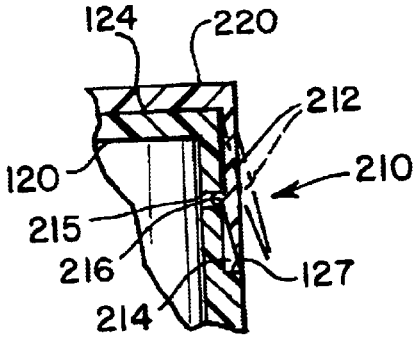
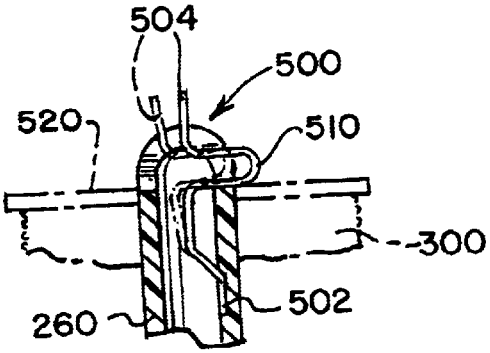
FIG. 6

FIG. 10
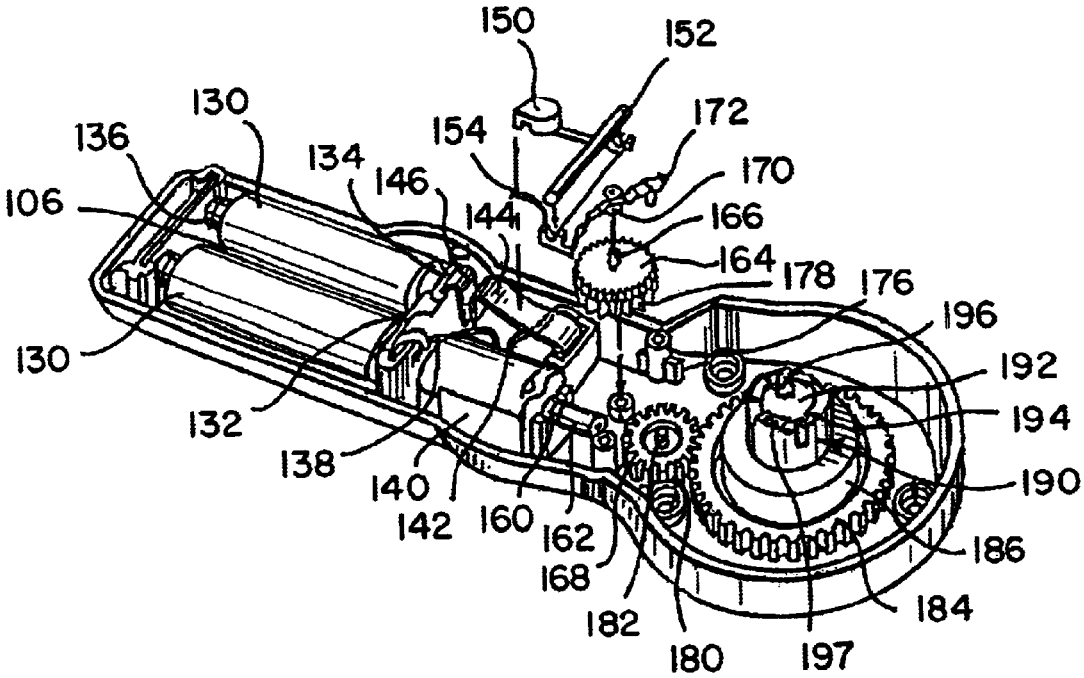
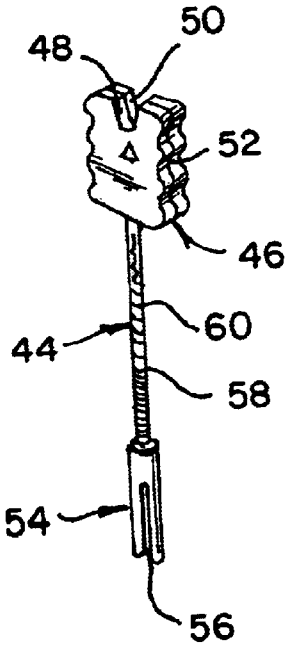
FIG. 11

HAIR WRAPPER

TECHNICAL FIELD

The present invention relates to a device for wrapping hair with a cord, and more particularly, to a hand-held device that wraps hair with a cord as an adornment and includes a plurality of spools for carrying and dispensing cord.

BACKGROUND

Hair wrapping devices are known which wrap cords around locks of hair. For example, U.S. Pat. No. 5,671,759, which is incorporated herein by reference in its entirety, discloses a simple, compact hair wrapper that is inexpensive to build and operate. The device includes a housing; a spindle operatively joined to the housing and defining a spindle bore for receiving cord and hair. The spindle also can have a detent for receiving the cord, The apparatus has a spool defining a spool bore through which the spindle is disposed and also the spool receives and dispenses the cord. Means for rotating the spindle relative to the housing and spool is provided such that the cord is dispensed from the spool through any detent (or cord tensions) and the spindle bore, hair is disposed in the spindle bore, and the spindle is rotated to wrap the hair with cord. The spindle is rotatably mounted within a hollow spool chamber which is partially defined by a spool cover, and the spool is disposed in the hollow spool chamber such that it is rotatable around the spindle to unwind cord as needed. The dispensing cord extends from the spool upwardly and then threaded through the spindle opening that also receives the locks of hair. Thus, the spindle and spool are all self-contained within the hollow spool chamber.

This design is constructed for placing one spool around the spindle and therefore only one spool is used at one time during a hair wrapping procedure. Many times, it is desirable to wrap more than one cord around the locks of hair since this permits multiple colored cords to be used. Accordingly, one of the deficiencies of this type of device is that only one spool can be used at one time and thus the hair wrapping patterns are limited and also because the one spool is stored underneath the spool cover, the switching of spools requires several steps to be performed.

What has heretofore not been available is a hair wrapper that is configured to carry multiple spools outside of an enclosed area to permit the user to easily selectively decide the number of cords to use and/or the colors of the cords.

SUMMARY

An apparatus for wrapping hair with a cord is provided and includes a housing; a main spindle operatively coupled to the housing and defining a main spindle bore for receiving cord and hair; and a rotatable spool carrier. The spool carrier has a platform and a drive spindle operatively coupled to the main spindle so that rotation of the main spindle is translated into rotation of the platform. The drive spindle has guides for receiving cord and permitting the cord to be disposed through a bore extending through the drive spindle.

The apparatus further includes at least one spool releasably secured to the platform in a rotatable manner with each spool carrying cord that is fed through one guide of the drive spindle. The rotation of the main spindle causes cord to be dispensed through the one guide and the drive spindle bore and the main spindle bore, hair is disposed through the drive spindle bore and the main spindle bore, and the main spindle is rotated to wrap the hair with cord.

In another aspect, an apparatus for wrapping hair with a cord in accordance with the invention is provided and can include a hand-held housing; a main spindle operatively coupled to the housing and defining a main spindle bore for receiving cord and hair; a rotatable platform coupled to the main spindle so that rotation of the main spindle is translated into rotation of the platform; guides rotatable with the platform for receiving cord and permitting the cord to be disposed through a bore extending through the platform; and at least one spool releasably secured to the platform in a rotatable manner, each spool carrying cord that is fed through one of the guides, the rotation of the main spindle causing cord to be dispensed through a particular one of the guides and the main spindle bore, hair is disposed through the main spindle bore, and the main spindle is rotated to wrap the hair with cord as the hand-held housing is moved relative to the hair.

In a further aspect, an apparatus for wrapping hair with a cord in accordance with the invention is provided and can include a hand-held housing; a gear mesh within the housing; a main spindle operatively coupled to the housing by the gear mesh and defining a main spindle bore for receiving cord and hair; a motor having a rotating shaft that is coupled to the gear mesh for transmitting rotation of the rotating shaft to the main spindle; a switch connected to selectively activate the motor; a rotatable platform coupled to the main spindle so that rotation of the main spindle is translated into rotation of the platform; a plurality of retaining posts extending outwardly from the platform; a plurality of guides rotatable with the platform for receiving a cord and permitting the cord to be disposed through a bore extending through the platform; at least two spools releasably secured in a rotatable manner on respective ones of the plurality of retaining posts, each spool carrying the cord and having the cord receivable in one of the plurality of guides; and a plurality of biased surfaces, each biased surface being positioned to provide frictional contact against a respective one of the at least two spools while the spools are disposed on respective ones of the retaining posts and to still permit the spool to freely rotate on each respective retaining post.

The above, and other objects, features and advantages of the present device will become apparent from the following description read in conjunction with the accompanying drawings, in which like reference numerals designate the same elements.

BRIEF DESCRIPTION OF THE DRAWING FIGURES

FIG. 3 is a cross-sectional view taken along the line 3—3 of FIG. 2;

FIG. 4 is a bottom perspective view of a portion of the rotatable spool carrier of FIG. 1;

FIG. 5 is a cross-sectional view of a section of the rotatable spool carrier illustrating tangs of a base section of the spool carrier engaging and interlocking with detents of a housing of the hair wrapper device;

FIG. 6 is cross-sectional view of a section of a retaining post and a biased mechanism for securing a spool to the retaining post;

FIG. 10 is a cut-away perspective view of the hair wrapper device illustrating an exemplary drive mechanism; and FIG. 11 is a perspective view of a bifurcated tool for feeding hair through the hair wrapping device of FIGS. 1 and 10 and for cutting the cord.

DETAILED DESCRIPTION OF PREFERRED EMBODIMENTS

Figure 1:
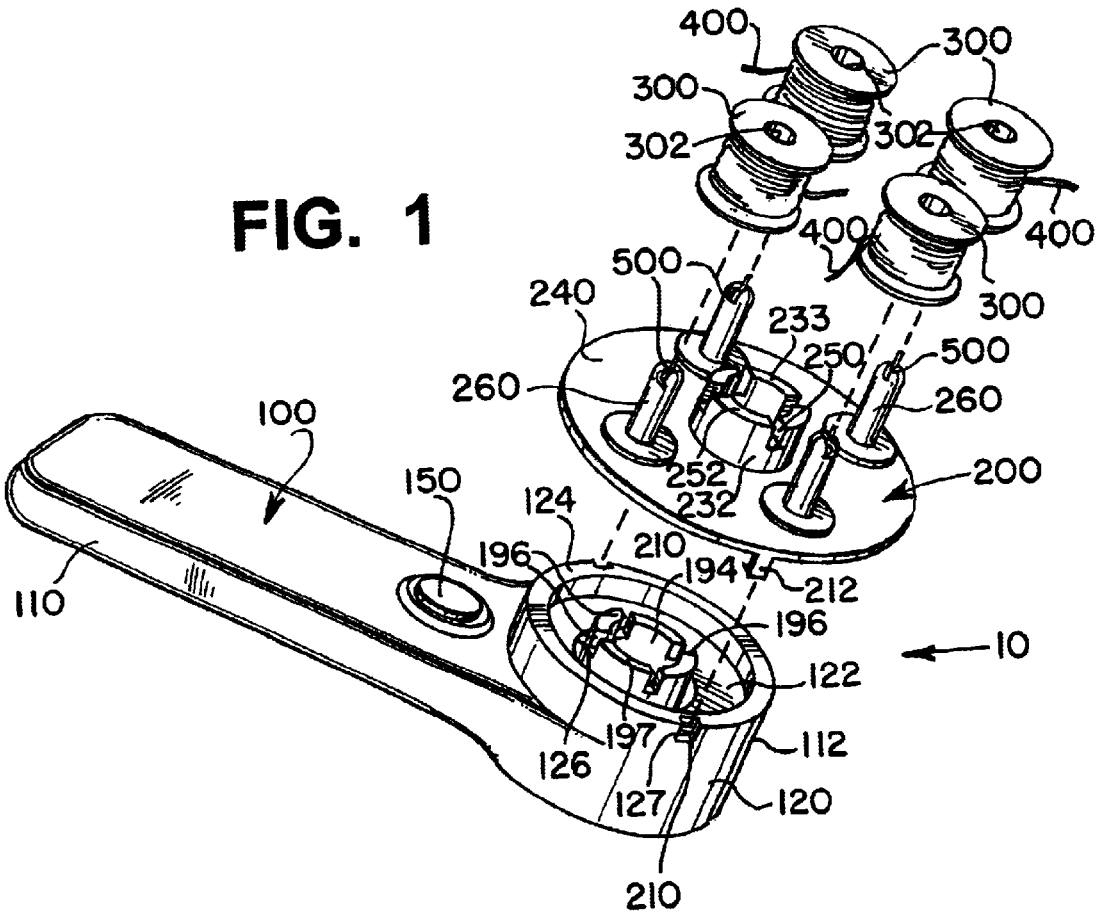
FIG. 1 is an exploded perspective view of a hair wrapper device with a rotatable spool carrier and a plurality of spools securely and rotatably coupled to the spool carrier according to a first embodiment.
Figure 2:
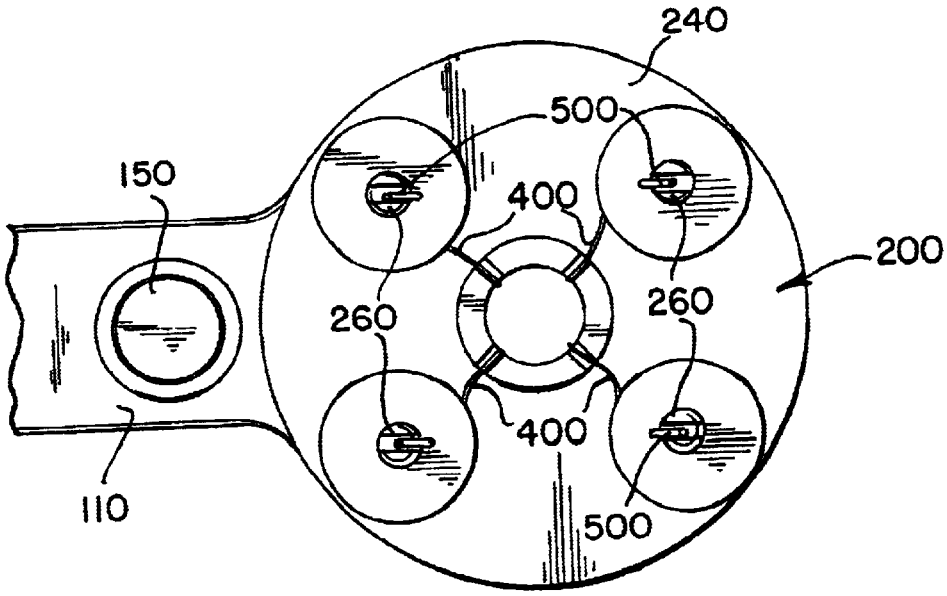
FIG. 2 is a top plan view of the rotatable spool carrier with the spools being coupled thereto.

FIG. 1 illustrates a hair wrapper assembly 10 according to a first embodiment. The hair wrapper assembly 110 includes a hair wrapper device 100 and a rotatable spool carrier 200 and a plurality of rotatable spools 300. The hair wrapper device 100 has a number of similarities with the hair wrapping device disclosed in U.S. Pat. No. 5,671,759, which is hereby incorporated by reference in its entirety. The hair wrapping device 100 includes a handle portion 110 and a spindle base section 120 formed at a distal end 112 of the handle portion 110. Preferably, the spindle base section 120 is integrally formed with the handle portion 110 at distal end 112 and has dimensions (e.g., width) slightly greater than the handle portion 110. For example, the handle portion 110 can taper outwardly at the distal end 112 to form the spindle base section 120 which has an arcuate shape and defines a distal end 102 of the hair wrapping device 100.

Much of the handle portion 110 and the spindle base section 120 is hollow and defines an interior compartment (indicated at 106 in FIG. 10) that stores many of the working components of the hair wrapping device 100. As will be described in greater detail hereinafter, the spindle base section 120 has a recessed floor 122 that is preferably planar with a peripheral rim 124 extending completely around the floor 122 at an outer peripheral edge thereof. Preferably, the peripheral rim 124 is integrally formed as part of the spindle base section 120 such the distal end 112 of the handle portion 110 flows smoothly into the spindle base section 120. According to one exemplary embodiment, the peripheral rim 124 is generally annular in shape. The recessed floor 122 has an opening 126 formed in a central portion thereof and as a result, the recessed floor 122 generally has a ring-like shape with the peripheral rim 124 at an outer peripheral edge thereof and the opening 126 defining a peripheral inner edge thereof. The opening 126 provides access to an inner chamber of the spindle base section 120.

As best shown in FIGS. 1, 3 and 5, the spindle base section 120 also includes a locking mechanism, generally indicated at 210, to releasably lock a base section 220 of the rotatable spool carrier 200 to the spindle base section 120. The locking mechanism 210 can comprise any number of traditional locking mechanisms that are suitable for use in the spindle base section 120 to releasable lock the base section 220 thereto. For example, one exemplary locking mechanism 210 includes a male snap element 212 that is associated with the cartridge base section 220 that is shaped to engage a female snap element 214 formed in the spindle base section 120. One exemplary male snap element 212 is a tang having a locking feature 216 formed therealong for engaging a detent 214 (i.e., the female snap element) formed in the spindle base section 120 in a releasably locking manner. More specifically, the detent 214 is a shaped cut-out formed in the spindle base section 120 and extending downward from a top edge of the peripheral rim 124 and terminating in a ledge 127. Formed within the detent 214 is an opening or slot 215 that forms an entrance into the interior chamber that is defined underneath the floor 122. The opening 215 is formed slightly above the ledge 127 and has a complementary shape so that the locking feature 216 of the tang 212 is received therein in the locked position. The locking feature 216 is not formed at a distal end of the tang 212 but rather is formed proximate thereto so that when the locking feature 216 engages and is received within the opening 215, the distal end of the tang 212 extends below the opening 215 but preferably does not extend all the way to the ledge 127. By providing a gap between the distal end of the tang 212 and the ledge 127, the user can grasp the distal end of the tang 212 even when the tang 212 is in the locked position (i.e., the locking feature 216 is disposed within the opening 215).

According to one embodiment, the locking feature 216 is a protrusion, rib, beveled member or the like that is shaped to be received within the opening 215. The tang 212 is a resilient member and therefore has some flexibility and is naturally biased inward so that when the tang 212 is received in the detent 214, the locking feature 216 will seat against the inner surface of the detent 214, resulting in the tang 212 flexing slightly outwardly. As the tang 212 travels within the detent 214 toward the ledge 127, the locking feature 216 becomes aligned with the opening 215 and is received therein to effectuate a releasably interlocking fit (e.g., snap fit) between the tang 212 and the detent 214. The natural bias force of the tang 212 is in an inward direction and therefore the locking feature 216 is biased into the opening 215 to further locate and lock the base section 220 of the rotatable spool carrier 200 relative to the hair wrapper device 100.

Now referring to FIGS. 1 and 10 which illustrates the interior compartment 106 that houses most of the working components of the hair wrapper device 100. The handle portion 110 defines a hollow space 111 that forms the part of the interior compartment 106 that is located within the handle portion 110. The hollow space 111 contains two AA size batteries 130 integrated into an electrical circuit by a positive contact 132, a negative contact 134 and a jumper contact 136. A wire lead 138 is joined to one positive contact and to a motor 140. Another wire lead 142 is connected to the motor 140 and to a button switch 144 made of resilient electrically conductive material. In the normal condition, the button switch 144 is up and spaced apart from a stationary contact 146 so that the circuit is open and the motor 140 is not energized. The stationary contact 148 is connected to the negative contact 134.

The button switch 144 can be pushed down by the button 150 which is preferably made of an insulating material and molded integrally with a pivot member 152 that rests in bearings 154. The button 150 is biased upward by the resilient button contact (switch) 144 in the normal condition. When pushed, the button 150 urges the resilient button contact 144 downward into electrical contact with the stationary contact 148 to close the circuit and energize the motor 140. The button 150 is accessible through a hole 156 formed in an upper surface 158 of the handle portion 110, preferably near the front of the handle portion 110 for easy access by a thumb.

The motor 140 can be Mabuchi model FA-260RA, RE-260RA, RE-140RA, or FA-130RA, or other suitable model. Further, the motor 140 can be powered by one or more batteries, or it can be powered interchangeably by one and two batteries to provide variable speed in the wrapping operation. A rocker switch can be used to dictate which of the two battery-powered modes will be used.

The motor 140 includes a shaft 160 that rotates when the motor 140 is energized. Fixed to the shaft 160 for rotation therewith is a worm gear 162. Meshed with worm gear 162 is a worm gear follower 164 that spins on a gear shaft 166 that is rotatably fitted into a lower bearing 168 that is located in a lower housing half of the handle portion 110. The upper end of the gear shaft 166 rides in an upper bearing 170 molded integrally into a plate 172 that also includes the bearings 154 for the button pivot member 152. Two downwardly extending pins 174 (only one is illustrated) hold the plate 172 securely in place by nesting is sockets 176 or the like. For example, the handle portion 110 can be formed of a housing upper half and a housing lower half that are secured to one another and define the chamber 111.

Referring back to the gear shaft 166, there also is a spur gear 178 fixed to the shaft 166 beneath the worm gear follower 164 for rotational movement therewith. An idler gear 180 is meshed with the spur gear 178 and rotationally mounted in the housing using a shaft 182 and bearings (not illustrated). Meshed to the idler gear 180, is a drum gear 184 that is rotatably mounted to the lower housing half and molded integrally with a drum 186. Alternative gear mesh arrangements could be used to transmit the rotary motion from the motor to the spindle, which one skilled in the art will appreciate. Further, a gear mesh can be used which incorporates a belt-drive which can reduce vibration, reduce noise, and provide a clutching mechanism which will slip when the spindle is restrained from rotating.

Molded integrally with and extending upward from the drum gear 184 is a reduced portion or spindle 190. The spindle 190 defines a bore 192 that extends between the top and bottom of the hollow chamber that is formed underneath the floor 122. The spindle 190 has an upper section 194 that extends above the planar upper surface of the floor 122. In other words, the spindle 190 extends through the opening 126 formed in the floor 122 such that a portion of the spindle 190 extends above the planar upper surface of the floor 122. The upper section 194 includes a plurality of detents 196 formed therein and separated by a plurality of flats 197.

The number of detents 196 can be varied; however, the detents 196 are preferably evenly spaced apart from one another such that a distance between any two adjacent detents 196 is the same. Each detent 196 is a slot or cut-out 197 formed in the upper section 194 from a top section thereof. For example, each detent 196 can have a generally rectangular shape with an upper end being open.

The relative height between the upper section 194 that extends above the floor 122 and the peripheral rim 124 can be varied; however, in one exemplary embodiment, the top of the spindle 190 does not extend above the peripheral rim 124. Preferably, the heights are approximately the same such that the top of the spindle 190 and the top of the peripheral rim 124 lie within the same plane. Preferably, the bottom of each detent 196 is located above the floor 122 so that the detent 196 does not extend within the opening 126 formed in the floor 122.

Because the spindle 190 forms a part of the drum gear 184 which is driven by the motor 140, the spindle 190 is likewise driven by the motor 140 in a rotating manner. By pushing the button 150, the electrical circuit is closed and the motor 140 is energized to rotate the spindle 190 through the gear mesh. When the spindle 190 rotates, the detents 196 will necessarily rotate since the detents 196 are formed in the spindle 190 itself.

As illustrated in FIGS. 1 and 3–5, the rotatable spool carrier 200 includes several sections including the base section 220, a rotatable drive spindle 230, and a rotating platform 240. As best shown in FIGS. 4–5, the base section 220 is configured to provide a base that releasably interlocks with the spindle base section 120. More specifically, the base section 220 includes a planar lower wall 222 that has an opening 224 formed in a central portion thereof. According to one exemplary embodiment, the planar lower wall 222 is in the form of a disk 222 and the opening 224 is a circular shaped opening. The disk 222 has an outer peripheral edge 226 and the diameter of the disk 222 is approximately equal to the diameter of the peripheral rim 124 so that the outer peripheral edge 226 aligns with the peripheral rim 124.

One or more tangs 212 are formed as part of the disk 222 and extend outwardly therefrom. More specifically, two tangs 212 extend downwardly from the disk 222 at the outer peripheral edge 226 thereof In one embodiment, the tangs 212 are disposed about 180° apart from one another. The tangs 212 thus supply the means for securely but releasably locking the disk 222 to the spindle base section 120.

The spool carrier 200 also includes the rotatable drive spindle 230 which is the drive means for causing rotation of the spool platform 240. The drive spindle 230 is formed of several sections, namely a first section 232 above the platform 240 and a second section 234 formed below the platform 240. The second section 234 is the section that mates with the spindle 190 of the hair wrapper device 100 so that rotation of the spindle 190 is translated into rotation of the rotatable drive spindle 230, which in turn is translated into rotation of the platform 240 as will be described hereinafter.

The drive spindle 230 is a hollow member and therefore both the first section 232 and the second section 234 have bores that extend therethrough. Accordingly, each of the first and second sections 232, 234 can be thought of as a tubular-like structure. The second section 234 has an annular base section 236 that terminates in a distal end 237. At the distal end 237, teeth 238 are formed to mate with and intimately intermesh with the detents 196 formed in the spindle 190. Each tooth 238 is therefore sized and shaped to be received within one detent 196. In the exemplary embodiment, each tooth 238 has a generally rectangular shape to permit reception in and mating with the rectangular detent 196. According to one exemplary embodiment, there are four teeth 238 that are evenly spaced around the annular base section 236 at the distal end 237 thereof. Preferably, the drive spindle 230 is an integral structure and is formed as a unitary plastic piece.

The annular base section 236 has an annular groove 239 formed therein between the distal end 237 and the platform 240. The annular groove 239 has a thickness that is slightly greater than a thickness of the disk 222 so as to permit the drive spindle 230 to be received within and through the opening 224 of the disk 222. An edge of the disk 222 that defines the opening 224 is received within the annular groove 239 to securely couple the drive spindle 230 to the disk 222 (i.e., the base section 220), while at the same time, the drive spindle 230 is rotable relative to the disk 222 of the base section 220. The base section 220 is stationary since it is interlocked to the spindle base section 120 by means of the tangs 212 interlocking with the detents 214 and therefore the annular groove 239 is configured to permit the drive spindle 230 to freely rotate relative to the disk 222.

The platform 240 is preferably integrally formed with the drive spindle 230 and extends radially outward therefrom.

According to one exemplary embodiment, the platform 240 is a disk that has an inner face 241 facing the hair wrapper device 100 and an outer face 242 that faces in the opposite direction. Because the drive spindle 230 extends through the platform (or thought of otherwise, the platform 240 is formed around the drive spindle 230), the platform 240 has a central opening 244 formed therein to accommodate the drive spindle 230. The opening 244 is axially aligned with the bore formed through the drive spindle 230 so that cord 400 and hair can be disposed completely therethrough as will be described hereinafter.

As best shown in FIG. 1, the first section 232 of the drive spindle 230 extends above the platform 240. The first section 232 terminates in a distal end 233 that has one or more and preferably a plurality of detents 250 formed therein. The detents 250 are spaced apart from one another (e.g., equally spaced apart), with flats 252 being formed between the detents 250 at the distal end 233. In one exemplary embodiment, the detents 250 are rectangular shaped; however, a number of other types of shapes can be u used so long as each detent 250 is configured to sufficiently hold and retain the cord 400 during an application.

The platform 240 has a diameter that is greater than the diameter of the disk 222 and thus the platform 240 overlies both the peripheral edge 226 of the disk 222 and the peripheral edge 124 of the spindle base section 120, as best shown in FIG. 4. The size of the platform 240 can be varied depending upon how much surface area is desired for holding the spools 300. In other words, the surface area of the platform 240 can be increased if more spools 300 are to be held thereon. The exemplary platform 240 shown in the embodiment of FIG. 1 is configured to hold four rotatable spools 300; however, it will be appreciated that the platform 240 can be constructed to hold less than four spools 300 (e.g., two spools 300) or greater than four spools 300 (e.g., five spools 300).

The spools 300 are of a replaceable type and are constructed to dispense cord 400. Each replaceable spool 300 defines a spool bore 302 sized so that it can receive a retaining post 260 for securely holding the spool 300 in place. According to this embodiment, the spools 300 are positioned along the upper face 242 of the platform 240 by disposing the spools 300 on the retaining posts 260 that are spaced along the upper face 242. Each retaining post 260 includes a retaining feature for securely holding one respective spool 300.

For example, a retaining feature 500 according to a first embodiment is generally shown in FIGS. 1–2, 3 and 6. In this embodiment, the retaining feature 500 is a biased clip for releasably engaging and holding the spool 300 in place. The retaining feature 500 includes a first end 502 that is secured to the retaining post 260 and a second free end 504 that extends above the retaining post 260 so that the user can grasp the retaining feature 500 and manipulate it to engage and lock the spool 300 in place. Between the first and second ends 502, 504, the biased clip 500 is bent in one or more spots. More specifically, the biased clip 500 includes at least a first bent portion 510 that is constructed to engage an upper face 520 of the spool 300. For example, the first bent portion 510 is a generally U-shaped bent portion formed near the second free end 504.

The clip 500 is biased outwardly as best shown in FIG. 6 and can be directed inwardly upon applying a force to the clip 500 to move the clip 500 to the position shown in phantom. In order for the spool 300 to be fitted over the retaining post 260, a force is applied against the clip 500 that overcomes the biasing force and thus results in the clip 500 moving to the position shown in phantom in FIG. 6. Once the clip 500 is retracted to the phantom position, the spool 300 can be inserted over the retaining post 260 and can be moved therealong. As soon as the clip 500 clears the upper face 520 of the spool 300, the clip 500 is released and the bent portion 510 engages the upper face 520. Because the clip 500 is naturally biased outwardly, the bent portion 510 applies a force to the upper face 520 of the spool 300 so as to hold the spool 300 downward, thereby securely holding the spool 300 on the retaining post 260.

To disengage the spool 300 from the retaining post 260, the user simply applies a force to the free second end 504 in a direction toward a central axis of the retaining post 260 until the bent portion 510 clears the upper face 520 of the spool 300. Once the bent portion 510 clears the upper face 520, the spool 300 can then be removed by simply lifting the spool 300 up so that the spool 300 clears the entire retaining post 260.

Figure 7:
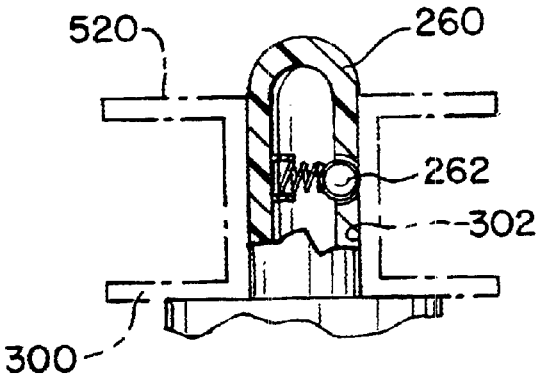
FIG. 7 is cross-sectional view of the retaining post and a biased mechanism according to another embodiment for securing a spool to the retaining post.

According to another embodiment illustrated in FIG. 7, each retaining post 260 can include a retaining feature in the form of a biased ball bearing 262 that is disposed within an opening formed in the post 260. The ball bearing 262 is naturally biased in an outward direction so that a portion of the ball bearing 262 protrudes beyond the post 260. When the spool 300 is disposed on the post 260 by inserting the post 260 within the spool bore 302, the ball bearing 262 is slightly retracted within its opening; however, the ball bearing 262 is biased against the spool 300. The biasing action of the ball bearing 262 against the spool 300 ensures that the spool 300 remains held in place on the retaining post 260 during use of the hair wrapping device 100. During normal use, the hair wrapping device 100 may be held at different angles and therefore it is desirable for the spools 300 to remain securely held along the upper face 242. The ball bearing 262 thus provides enough frictional contact against the spool 300 to hold it; however, the spool 300 is still permitted to freely rotate on the retaining post 260 to unwind dispensing cord 400 as needed. If the ball bearing 262 is not provided, the spool 300 will freely rotate on the retaining post 260 without any significant resistance and in the embodiment where the ball bearing 262 is provided, the spool 300 is friction fit over the retaining post 260 so that a greater degree of tension in the cord 400 is necessary to spin the spool 300.

Figure 8:
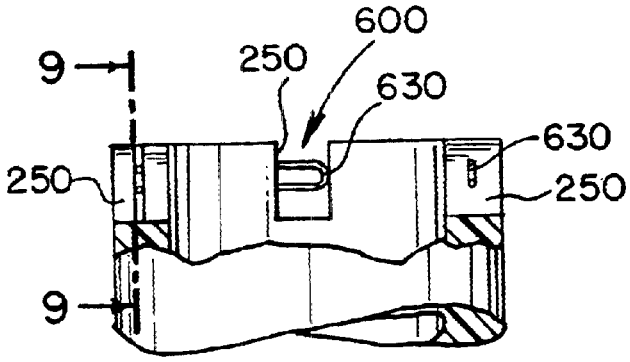
FIG. 8 is a cross-sectional view of a retaining post and a mechanism for securely retaining the cord within a detent formed as part of a drive spindle.
Figure 9A:
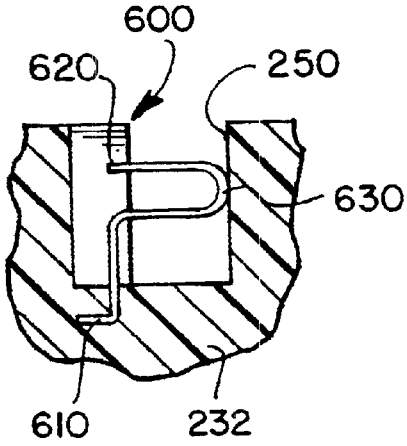
FIG. 9A is an enlarged sectional view of the mechanism of FIG. 8.
Figure 9B:
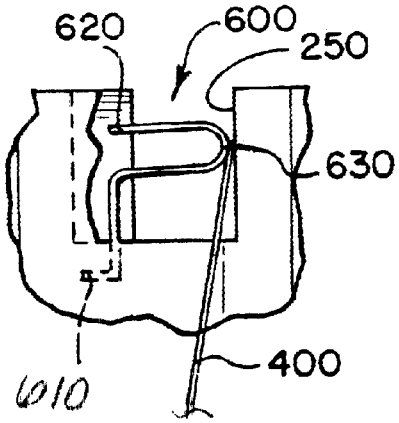
FIG. 9B is an enlarged sectional view of the mechanism of FIG. 8 with the cord being inserted into a guide.

FIGS. 8–9B illustrate a mechanism 600 for retaining the cord 400 within the guide 250. The exemplary mechanism 600 is a wire clip having a first end 610 that is attached to the first section 232 and an opposing second end 620 that is disposed within the guide 250. Between the two ends 610, 620, the wire 600 is bent at a section 630 to assume a shape such that it extends substantially across the width of the guide 250. One exemplary shape is a U-shape. The wire 600 is a resilient member and enjoys a degree of flexing to permit the cord 400 to be disposed between the section 630 and the wall of the guide 250, as best shown in FIG. 9B. Once the cord 400 clears the section 630, it is securely within the guide 250 underneath the bent section 630. During use, the bent section 630 prevents the cord 400 from being displaced laterally out of the guide 250.

The cord 400 is of a type that is commonly used with these type of hair wrapper devices. For example, the cord 400 can be formed of a synthetic material, such as a nylon thread, or the it can be formed of a natural material, such as a cotton thread. The cord 400 is wrapped around a base section 303 of the spool 300 and has a first end that is attached to the base section 303 using conventional techniques, such an adhesive or by a mechanical fit between the cord end and the base section 303 and an opposing second end 305 that is a free cord end.

Because the spools 300 are disposed on top of the upper face 242 of the platform 240, the user can visually see what types and how many cords 400 are available for use. For example, the color and texture of the cord 400 can readily be determined by looking at the second end 305.

The coupling of one spool carrier 200 to the hair wrapper device 100 and the dispensing of cord(s) 400 will now be described. The spool carrier 200 is preferably first releasably interlocked with the hair wrapper device 100 by inserting the tangs 212 into detents 214 such that the locking features 216 of the tangs 212 engage and interlock with the openings or slots 215 formed in the detents 214. Concurrently, the drive spindle 230 of the spool carrier 200 is orientated so that the teeth 238 thereof mesh with and releasably interlock with the detents 196 of the spindle 190. The teeth 238 are received within the detents 196 in such away (e.g., frictional/mechanical fit) that results in the two parts being securely mated to one another. Because of this type of interlocking fit, the driving of the spindle 190 is directly translated into the drive spindle 230 being driven without the drive spindle 230 excessively losing transferred energy due to slippage or the like.

If the spools 300 are not already disposed on the retaining posts 260, the user completes this task in the manner described above. For purpose of illustration, the exemplary application will be described in terms of using a plurality of spools 300; however, it will be appreciated that only one spool 300 can be used for a given application.

The cord 400 of one spool 300 is inserted through the detent 240 and is then inserted into the bore formed in the first section 232 of the drive spindle 230. The cord 400 extends completely through the bore of the drive spindle 230 and the cord 400 is disposed through the spindle bore 192 of the spindle 190 and then ultimately through the opening 126 formed in the spindle base section 120 such that the cord 400 extends below the hair wrapper device 100. Tension can applied to the cord 400 to assist the user in this task. In other words, the cord 400 can be drawn (i.e., pulled) through the spindle bores until a predetermined length extends below a lower face of the hair wrapper device 100.

If it is desired to wrap more than one cord 400 around the hair, the user simply disposes more than one spool 300 on the platform 240 and then feeds a free end of one cord 400 through one detent 250 and each of the other cords 400 is fed into another detent 250. After being fed through respective detents 250, the cords 400 are then disposed into and through the bores of the drive spindle 230 and spindle 190 as described above.

After the cords 400 are fed through the spindle bores, a lock of hair to be wrapped is inserted in the slot 56 on the bifurcated hair feeding tool 54. The tool 54 is then pushed down through the spindle bore of the drive spindle 230 and the spindle bore 192 along side the cords 400. By simply sliding the hair out of the slot 56, the tool 54 can be withdrawn from the spindle bores.

By pushing the button 150, the electrical circuit is closed and the motor 140 is energized to rotate the spindle 190 through the gear mesh. Because the spool carrier 200 is directly coupled to the spindle 190, the rotation of the spindle 190 is translated into direct rotation of the drive spindle 230 of the spool carrier 200. As the drive spindle 230 rotates, the detents 250 of the drive spindle 230 rotate, as well, to dispense the cord 400 from the spool 300 and wrap the hair with the cords 400. The platform 240 on which the spools 300 are disposed rotates because of its integral connection to the rotating drive spindle 230 and the spools 300 are themselves rotatable relative to the rotating platform 240 since the spools 300 are rotatably mounted on retaining posts 260.

As the cords 400 are being wrapped around the hair, it is desirable to pull the hair out the spindle bore 192 slowly so that the hair is wrapped along the desired length. Further slow pulling will result in a closer wrap than a quicker pull.

When the hair is wrapped to the desired amount and appearance, the hair is pulled out of the spindle bore 192 completely and the cords 400 are cut with scissors or by sliding the cords 400 into the cutting device's tapered guides 48 against the razor 50. The ends of the cords 400 can be tied, clipped, or beaded together to ornamentally secure the wrapping or another color or texture of cord can be wrapped on and tied to the previously wrapped cords 400.

In an alternative embodiment, the floor 122 and peripheral rim 123 are omitted and instead the rotatable rotating platform 240' is affixed directly to the spindle 190' and includes the retaining posts 260 for holding spindles. In this embodiment, there is no need for the base section 220 or the spool carrier 200, or for the second section 234 of the rotatable drive spindle 230. The first section 232' above the rotating platform 240' continues to provide a drive for further platforms or cartridges of the type described in co-pending U.S. Patent Application Serial. No. To Be Assigned, filed Aug. 7, 2002, and entitled "HAIR WRAPPER WITH STACKABLE CARTRIDGES AND CARTRIDGES FOR THE SAME".

While the invention has been particularly shown and described with reference to preferred embodiments thereof, it will be understood by those skilled in the art that various changes in form and details can be made without departing from the spirit and scope of the invention.

What is claimed is:

1. An apparatus for wrapping hair with a cord, comprising:

a housing;

a main spindle operatively coupled to the housing and defining a main spindle bore for receiving cord and hair;

a rotatable spool carrier having a platform and a drive spindle operatively coupled to the main spindle so that rotation of the main spindle is translated into rotation of the platform, the drive spindle having guides for receiving cord and permitting the cord to be disposed through a bore extending through the drive spindle; and at least one spool releasably secured to the platform in a rotatable manner, each spool carrying cord that is fed through one guide of the drive spindle, the rotation of the main spindle causing cord to be dispensed through the one guide and the drive spindle bore and the main spindle bore, hair is disposed through the drive spindle bore and the main spindle bore, and the main spindle is rotated to wrap the hair with cord.

2. The apparatus of claim 1, wherein the main spindle includes a first drive coupling feature and the. drive spindle includes a second drive coupling feature that mates with the first drive coupling feature to translate rotation of the main spindle into rotation of the drive spindle.

3. The apparatus of claim 2, wherein the first drive coupling feature comprises a plurality of detents formed at one end of the main spindle and the second drive coupling feature comprises a plurality of complementary teeth formed at one end of the drive spindle, the teeth intimately engaging the plurality of detents to establish a frictional fit therebetween.

4. The apparatus of claim 2, wherein the housing includes a spindle base section having a floor with an opening formed therein, the main spindle extending through the opening so that the first drive coupling feature is disposed at least partially above the floor.

5. The apparatus of claim 1, wherein the main spindle is operatively coupled to a gear mesh for transmitting rotation to the main spindle.

6. The apparatus of claim 5, further including:

a motor having a rotating shaft that is coupled to the gear mesh for transmitting rotation of the rotating shaft to the main spindle; and a switch for activating the motor.

7. The apparatus of claim 1, wherein the rotatable spool carrier includes a base section that releasably interlocks with the housing, while the platform and the drive spindle are rotatable relative to the base section.

8. The apparatus of claim 7, wherein the base section includes at least two tangs extending downwardly therefrom for releasably interlocking with detents formed in the housing.

9. The apparatus of claim 7, wherein the base section has an opening formed therein for receiving the drive spindle, the platform being disposed above the base section, the drive spindle being coupled to the base section such that the drive spindle is freely rotatable relative to the base section.

10. The apparatus of claim 9, wherein the drive spindle includes an annular groove formed therein for receiving a portion of the base section so as to couple the drive spindle to the base section while permitting rotation of the drive spindle relative to the base section.

11. The apparatus of claim 1, wherein the platform is integral to the drive spindle with the detents of the drive spindle being formed above the platform.

12. The apparatus of claim 1, wherein the platform includes a plurality of retaining posts extending outwardly therefrom for each receiving one spool which is permitted to rotate thereabout.

13. The apparatus of claim 12, wherein each retaining post includes a retaining feature for securely holding one respective-spool.

14. The apparatus of claim 13, wherein the retaining feature comprises a biased ball bearing that is disposed within an opening formed in the retaining post, the ball bearing being biased in an outward direction so that the ball bearing engages and applies a biasing force against the spool to further ensure that the spool remains coupled to the retaining post.

15. The apparatus of claim 1, wherein more than three spools are coupled to the platform with a cord of each spool being received within one guide.

16. The apparatus of claim 1, wherein the drive spindle has a cord retaining feature associated with each guide for holding the cord within the guide.

17. The apparatus of claim 16, wherein the cord retaining feature comprises a clip disposed across an open end of the guide, the cord being inserted into the guide by sliding the cord underneath the clip and into the guide.

18. The apparatus of claim 1, wherein the spool is disposed outside of the housing and a position between the detent of the drive spindle and the spool remains fixed when the platform rotates to dispense and wrap cord around the hair.

19. The apparatus of claim 1, wherein the guide comprises a detent.

20. An apparatus for wrapping hair with a cord, comprising:

a hand-held housing;

a main spindle-operatively coupled to the housing and defining a main spindle bore for receiving cord and hair;

a rotatable platform coupled to the main spindle so that rotation of the main spindle is translated into rotation of the platform;

guides rotatable with the platform for receiving cord and permitting the cord to be disposed through a bore extending through the platform; and at least one spool releasably secured to the platform in a rotatable manner, each spool carrying cord that is fed through one of the guides, the rotation of the main spindle causing cord to be dispensed through a particular one of the guides and the main spindle bore, hair is disposed through the main spindle bore, and the main spindle is rotated to wrap the hair with cord as the hand-held housing is moved relative to the hair.

21. The apparatus of claim 20, wherein the main spindle is operatively coupled to a gear mesh for transmitting rotation to the main spindle.

22. The apparatus of claim 21, further including:

a motor having a rotating shaft that is coupled to the gear mesh for transmitting rotation of the rotating shaft to the main spindle; and a switch for activating the motor.

23. The apparatus of claim 20, wherein the platform includes a plurality of retaining posts extending outwardly therefrom for each receiving one spool which is permitted to rotate thereabout.

24. The apparatus of claim 23, further comprising a biased surface positioned to provide frictional contact against the spool disposed on a particular retaining post while still permitting the spool to freely rotate on the particular retaining post.

25. The apparatus of claim 23, wherein each retaining post includes a retaining feature for securely holding one respective spool.

26. The apparatus of claim 25, wherein the retaining feature comprises a biased ball bearing that is disposed within an opening formed in the retaining post, the ball bearing being biased in an outward direction so that the ball bearing engages and applies a biasing force against the spool to further ensure that the spool remains coupled to the retaining post.

27. The apparatus of claim 20, wherein more than two spools are coupled to the platform with a cord of each spool being received within one guide.

28. The apparatus of claim 20, further comprising a cord retaining feature disposed across an open end of the guides.

29. The apparatus of claim 20, wherein each guide comprises a detent.

30. An apparatus for wrapping hair with a cord, comprising:

a hand-held housing;

a gear mesh within the housing;

a main spindle operatively coupled to the housing by the gear mesh and defining a main spindle bore for receiving cord and hair;

a motor having a rotating shaft that is coupled to the gear mesh for transmitting rotation of the rotating shaft to the main spindle;

a switch connected to selectively activate the motor;

a rotatable platform coupled to the main spindle so that rotation of the main spindle is translated into rotation of the platform;

a plurality of retaining posts extending outwardly from the platform;

a plurality of guides rotatable with the platform for receiving a cord and permitting the cord to be disposed through a bore extending through the platform;

at least two spools releasably secured in a rotatable manner on respective ones of the plurality of retaining posts, each spool carrying the cord and having the cord receivable in one of the plurality of guides; and a plurality of biased surfaces, each biased surface being positioned to provide frictional contact against a respective one of the at least two spools while the spools are disposed on respective ones of the retaining posts and to still permit the spool to freely rotate on each respective retaining post.

31. The apparatus of claim 30, further comprising a cord retaining feature disposed across an open end of the plurality of guides.

32. The apparatus of claim 30, wherein each guide comprises a detent.

* * * * *